United States Patent [19]

Drake

[11] 4,270,467

[45] Jun. 2, 1981

[54] LOW MASS FLOW WASTE FUEL INCINERATOR

[75] Inventor: Dale E. Drake, Concrete, Wash.

[73] Assignee: Enertherm, Inc., Mount Vernon, Wash.

[21] Appl. No.: 111,877

[22] Filed: Jan. 14, 1980

[51] Int. Cl.[3] ..... F23J 3/00

[52] U.S. Cl. ..... 110/216; 432/72; 110/212; 110/248; 110/251; 110/165 R

[58] Field of Search ..... 110/205, 208, 209, 212, 110/214, 216, 248, 165 R, 251, 254; 432/72

[56] References Cited

U.S. PATENT DOCUMENTS

| | | | |
|---|---|---|---|
| 2,128,431 | 8/1938 | Raisch | 110/254 |
| 3,917,444 | 11/1975 | Canthew | 432/72 |
| 3,945,331 | 3/1976 | Drake et al. | 110/203 |
| 3,995,567 | 12/1976 | Drake et al. | 110/190 |
| 4,013,023 | 3/1977 | Lombana et al. | 110/212 |
| 4,021,192 | 5/1977 | Ferguson et al. | 432/72 |
| 4,023,508 | 5/1977 | Cantrell, Jr. et al. | 110/212 |
| 4,140,467 | 2/1979 | Ellison et al. | 432/72 |

*Primary Examiner*—Henry C. Yuen

*Attorney, Agent, or Firm*—Warren J. Krauss

[57] ABSTRACT

A system for the combustion of waste products for the extraction of heat energy in a clean pollutant-free medium. The system includes a swirling air-cyclonic type incinerator having means for controllably consuming fuel in the form of waste products of various grades and heating values. Incinerator outlet means are provided for transmitting gaseous combustion products to a heat exchanger, a filtering device, and ultimately to a point of beneficial utilization. Through a plurality of ducts, control valves, and pumping means, a selectably variable volume of oxygen necessary to support combustion is taken from the ambient. The remaining gas flow to the incinerator for such purposes as creation of a swirling flow and cooling is pumped from the outlet side of the heat exchanger. By thus recirculating and utilizing the oxygen depleted exhaust products for incinerator functions in lieu of ambient air, the noted functions may be obtained without adding energy to heat the ambient air and without increasing the mass flow in the overall system. The temperature extant at the outlet of the incinerator may be readily controlled and the oxygen content of the combustion supporting gases may be directly regulated in accordance with the specific requirements of the particular fuel being burned.

10 Claims, 3 Drawing Figures

LOW MASS FLOW WASTE FUEL INCINERATOR

CROSS-REFERENCE TO RELATED APPLICATIONS

The present application relates to U.S. Pat. No. 3,945,331 entitled: THERMAL RECOVERY SYSTEM, issued Mar. 23, 1976, to Drake, et al., and U.S. Pat. No. 3,995,567 entitled: WASTE FUEL INCINERATOR AND POLLUTANT REMOVAL SYSTEM, issued Dec. 7, 1976, to Drake, et al., both of common assignment herewith.

BACKGROUND OF THE INVENTION

This invention relates to an incinerating system which advantageously utilizes normally wasted materials as fuel to produce heat energy without creating air pollution. In particular, the invention relates to an incinerator equipped with a heat exchanger, filtration means, and gas flow control devices, which combusts waste fuel, such as wood chips and shavings in a lumber mill, and recirculates the products of combustion to the incinerator for cooling and interior circulation. It extracts a maximum value of heat energy from the products of combustion with a minimal effect on the environment; either through release of pollutants or utilization of ambient air.

In industrial operations where waste product production is voluminous, such as in the lumber industry, the waste disposal problem is serious. Not only is it critically important to dispose of such wastes without injuring the environment, but it is also necessary to economically extract the energy content of the waste before disposal thereof so as not to squander a precious form of energy. Thus industry has long sought a system for concurrently extracting energy from waste, reducing the volume of the remainder thereof after combustion, and efficiently utilizing the energy obtained for useful purposes.

Attempts have been made to achieve these goals. The aforementioned United States patents to Drake, et al., disclose superior systems which efficiently consume waste materials and utilize the heated combustion products for useful purposes such as drying lumber, producing steam for the generation of electricity, and the like.

U.S. Pat. No. 3,945,331 describes an incinerator wherein the temperature of the exhaust products are controlled by the introduction of cold ambient air through a control valve. The patented system modulates the temperature of the exhaust products outside of the incinerator, i.e., to prepare the gases for a point of utilization.

U.S. Pat. No. 3,995,567 teaches a more advanced system wherein the exhaust gases are cooled and filtered to minute specifications before final release into the atmosphere. The system also includes a plurality of temperature controlled blowers in the incinerator walls for regulating the burning temperature of the fuel and for "after burning" particulate suspended in the exhaust from the primary burning area. Such "over fire" blowers direct ambient air to the interior of the incinerator and necessarily increase the mass gas flow of the system.

This invention is directed toward the achievement of an incinerating system which provides an efficient, low pollutant, burning of waste fuels to release heat energy without increasing the mass gas flow of the system despite the utilization of a variety of types and grades of fuel.

SUMMARY AND OBJECTS OF THE INVENTION

This invention provides an incinerating system which utilizes available waste, such as lumber shavings, bark, etc., as fuel for releasing heat energy for useful purposes such as drying wood or producing steam for the generation of electricity. The system extracts substantially all the useful energy from the products of combustion and removes most of the pollutants therefrom before release thereof to the atmosphere. It is capable of consuming fuels having various grades and heating values in a relatively controlled temperature, pressure, and flow context. The interior of the incinerator is temperature controlled by cooling gases which are taken from a downstream, relatively cooler, fraction of the products of combustion. Such gaseous products are passed through a heat exchanger to transfer heat to air from the ambient without mixing the ambient air and the exhaust products. The utilization of oxygen depleted gaseous exhaust products for cooling the incinerator and producing the swirling effect therein does not increase the mass gas flow of the system and creates a substantially closed system for the complete consumption of waste fuel.

The primary object of the present invention is to provide means for substantially completely consuming waste fuels while recovering and utilizing the heat energy therefrom.

Another object of the present invention is to provide a waste fuel incinerating system which is particularly applicable to lumber mill operations where there is an abundant production of wood wastes and a corresponding need for a hot, clean gaseous medium for lumber drying and treating processes.

The further object of the present invention is to provide a system for modulating the temperature within an incinerator so that a variety of waste fuels may be efficiently burned without increasing the mass flow of the system.

Another object of the present invention is to provide control means for sensing the combustion requirements of particular fuels and automatically regulating the temperatures, pressures, and flow rates in the system to achieve efficient operation.

Yet another object of this invention is to provide a system for incinerating waste fuels to extract useful energy therefrom; wherein all necessary combustion functions are performed with the minimum addition of external energy and air, with consequent increases in efficiency and savings in cost.

Other objects and advantages of the present invention will become readily apparent from the following description and drawings.

DETAILED DESCRIPTION

Figure 1:
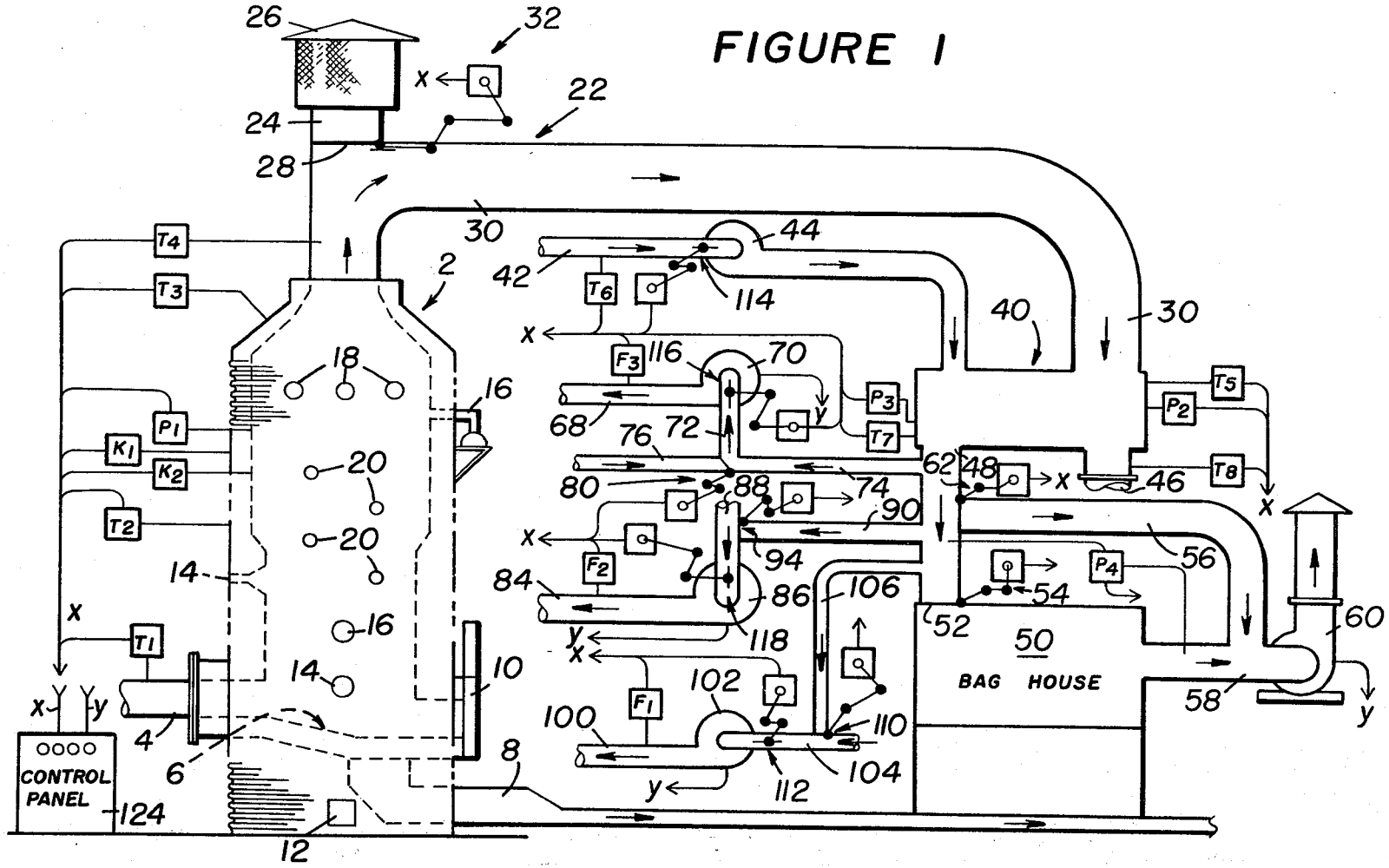
FIG. 1 is a schematic representation of the entire system showing the incinerator, the exhaust treatment stage and the control devices for moving gases within the system.

With reference to the schematic representation in FIG. 1, the overall system any be appreciated. The dimensions of the components are not to scale since they depend upon the particular requirements of the given installation. For example, a system producing heated clean air for drying wood in a kiln in a lumber operation would be dimensioned differently from an installation intended to generate steam for the production of electric power.

The incinerator section of the instant system is shown generally at 2. The fabrication and materials of the incinerator stage will be discussed in more detail hereinafter with reference to FIGS. 2 and 3 of the drawings. A fuel inlet chute 4 is provided for leading fuel to a perforated grate and ash removal system shown generally at 6. Ashes and solid remains of the consumed fuel are removed through the removal tunnel 8 for processing and ultimate disposal. Access to the combustion zone is obtained through a guillotine style clean-out door 10.

Primary air for supporting combustion of the waste fuel on the grate system 6 is provided through an under fire air inlet 12 which transmits ambient air to the underportion of the perforated grate 6 for transmission therethrough to support combustion. A plurality of observation ports 14 are suitably provided for visual inspection of the combustion chamber for readings of opacity and burn color. Ignition burners 16 (only one of which is shown) are provided at a plurality of locations for initiating and controllably maintaining combustion process at various vertical levels of the incinerator and for providing, in conjunction with the gas and air inflow means, regulation of temperatures in the combustion chamber.

Cooling fluid inlet ports for additionally regulating combustion temperatures are provided at 18. Overfire air inlet ports are shown at 20. Both the cooling fluid inlet ports and overfire gas inlet ports are positioned within the generally cylindrical combustion chamber wall to provide a swirling or circulating flow pattern which enhances the natural cyclonic effect of moving gases and increases the burning retention time of any given volume of combustion products. Reference to U.S. Pat. No. 3,995,567, column three, may be had for a fuller explanation of the swirling gas incinerating concept.

An exhaust conduit stage for transmitting products of combustion from the combustion chamber is shown generally at 22. At a first branch of the conduit is a relief exit 24 provided with a suitable spark arrester and rain cap 26. A relief valve, having closure means 28 is arranged for selectively pivotably totally or partially blocking either the relief exit 24 or a regenerative branch 30. The operation of the relief valve closure means 28 is suitably controlled, in response to selectable command parameters, through the linkage and actuator means 32.

In normal operation, hot gases issuing from the incinerator stage 2 are transmitted through the regenerative branch 30 in the direction of the arrows to a heat exchanger section shown generally at 40. This heat exchanger, shown schematically because of the many designs that it could possibly have, serves to extract the major portion of the heat energy from the hot products of combustion in the regenerative branch and to transmit such energy to a secondary medium, be it liquid or gaseous in form, for immediate or ultimate use. By way of example, the heat exchanger could take the form of a plurality of water or air containing metallic tubes in surrounding and intimate contact with the hot exhaust gases such that the heat from the exhaust gases would be transferred through the walls of the tubes and to the conveying medium. The conveying medium remains isolated from and uncontaminated by the exhaust gases. The particular example shown in FIG. 1 utilizes ambient air as the heat exchanger conveying medium.

Such ambient air, at a relatively low temperature, is pumped into the heat exchanger via a conduit 42 by means of suitable centrifugal or other type gas pump 44. After a tortuous counterflow path through the heat exchanger whereby the air absorbs heat from the hot exhaust gases, the heated medium exits the heat exchanger at 46. In a similar manner, the energy depleted gases which entered the heat exchanger through the branch conduit 30 exit the heat exchanger at 48.

For illustrative purposes, examples of the ranges of temperatures found in a typical system will be provided. The temperature of the gases extant at a point T3 in the exhaust zone of the combustion chamber could be between 1,000° F.–1,400° F. By the time the gases have reached the inlet to a heat exchanger 40 at a point T5, they can be expected to reach a temperature range of 1,000° F.–1,200° F. At the outlet of the heat exchanger 40 at a point T7, the exhaust gas temperature has reduced to between 350° F. and 450° F. In contrast thereto, the burning temperatures in the primary section of the combustion chamber, i.e., at a point T2, are within the range 2,400° F.–3,000° F.

From the exhaust products exit 48, the hot gases are delivered to a filtering station or "bag house" 50 wherein particulate is removed by filtration means. A suitable filtering system is shown in detail in U.S. Pat. No. 3,995,567 to Drake, et al.

Admission of the exhaust gases to the bag house, or other gas processing device is controlled by bag house entrance valve 52, suitably controlled and actuated by the actuator and linkage means 54.

A bypass duct 56 is provided for selectively shunting exhaust gases from the heat exchanger directly into the ultimate exhaust conduit 58 for pumping, by means of a pump 60, to without the system. Bypassing of gases through the duct 56 permits the cleaning or replacement of waste collection bags from the bag house 50 without need for a system shutdown. Passage of gases through the bypass duct 56 is suitably controlled by means of a valve shown generally at 62.

The cooling fluid inlet ports 18 are supplied by means of the conduit 68. The cooling fluid is pumped through a centrifugal pump 70 from an inlet conduit 72. Conduit 72 draws fluid from the outlet of the heat exchanger via a conduit 74 and, selectively, from an ambient or fresh air supply via a conduit 76 when a cooling fluid control valve, shown generally at 80, permits passage through the conduit 76. It may be readily appreciated that ratio of fresh air to heat exchanger gas and consequently the temperature and oxygen ratios of the cooling fluid passing through the conduit 68 are selectively variable through the controlled actuation of the cooling fluid control valve 80.

The overfire supply ports 20 are supplied through the conduit 84 which, in turn, receives exhaust from the centrifugal pump 86. The inlet side of the pump 86 draws fresh air from the ambient or other source of supply through a conduit 88 and draws oxygen-depleted exhaust gases from the heat exchanger through the conduit 90. The relative proportions of oxygen rich air from the conduit 88 and exhaust products through the conduit 90 are controlled by means of an overfire fluid control valve, shown generally at 94.

Underfire air for supply to the primary air inlet 12 is supplied through a conduit 100. A suitable centrifugal pump 102 draws ambient air from the conduit 104 and/or exhaust products from the heat exchanger through the conduit 106. The ratio of oxygen depleted exhaust gases from the conduit 106 to fresh air from the conduit 104 is suitably controlled by the ratio control valve shown generally at 110.

The combined mass flow through the pump 102 is controlled by means of the underfire fluid mass control valve, shown generally at 112. It may also be noted that the mass flow through each of the pumps 44, 70, and 86 are suitably controlled by mass flow control valves 114, 116, and 118, respectively.

The various control valves and pumping mechanisms are selectively automatically, semi-automatically, or manually controlled by means of the control panel 124. The control panel includes gauges showing the state of operability of each of the pumps, valves, burners, and motors and includes temperature, pressure, and flow inputs for sensing the pressure, temperature, and flow rates at various points in the system and signalling the operation of the various valves and pumps in response thereto.

The control system can automatically regulate the aforementioned multiple functions of the incinerating system by collecting and evaluating the following parameters. In addition to the above-discussed sensing of temperatures at points T2, T3, T5, and T7, temperature inputs are taken from other strategic points. At T1, the temperature of the fuel at the inlet 4 is sensed and transmitted to the control panel 124 with other complex signals through a transmitting conduit, conveniently marked for illustrative purposes, "x". For ease in description, all functions fed through the conduit "x" are inputed to the control panel through the terminal "x". The same obtains for control functions transmitted through the conduit "4" to the terminal "y". It should be noted, however, that the drawings provide only a simple schematic illustration of this feature and the means for collecting control functions and the control panel in and of itself, are not subjects of this invention.

Temperature is also sensed at a point T4 in the exhaust conduit immediately proximate and beyond the juncture of the incinerator body 2 and the exhaust conduit 22. At T6 is sensed the temperature of the fresh air or other coolant medium for the heat exchanger 40. At T8, the temperature of the coolant medium as it exits the heat exchanger, is taken.

Similarly, pressure values are taken at various points in the system and transmitted to the control panel 124. At P1, the pressure within the combustion chamber is taken. At P2 and P3, the heat exchanger inlet and outlet pressures are taken. At P4, the differential pressure between the inlet and outlet conduits for the bag house is taken and transmitted to the control panel through the conduit "x".

At K1 and K2 are two oxygen sensors for sensing the percentage of oxygen in the combustion gases. These signals allow the maximization of efficiency and minimization of mass flow by permitting the reduction of excess oxygen laden air to the minimum required for adequate combustion.

Flow is measured by means of suitable flow meters F1, F2, F3. F1 measures the volume flow rate of the underfire support air passing through the inlet 12. F2 measures the volume flow rate of the overfire fluid supply through the conduit 84 to the ports 20. F3, in a similar fashion, measures the volume flow rate of cooling fluid transmitted to the ports 18.

An additional input to the control panel 124 is the physical position of the various valve actuators in the system. For example, the position of the mass flow control valve 112 for the underfire air supply is conveniently taken directly from the valve actuator and transmitted through the conduit "x" to the control panel. In a like manner, the positions of the ratio control valve 110, the mass flow control valves for the overfire fluid, the cooling fluid, the heat exchanger coolant fluid, the bag house bypass valve 62, and the bag house entry valve 52 can be taken. Finally, the position of the relief valve 28 is conveniently taken through its actuator 32 for transmission to the control panel 124 through the line "x".

Figure 3:
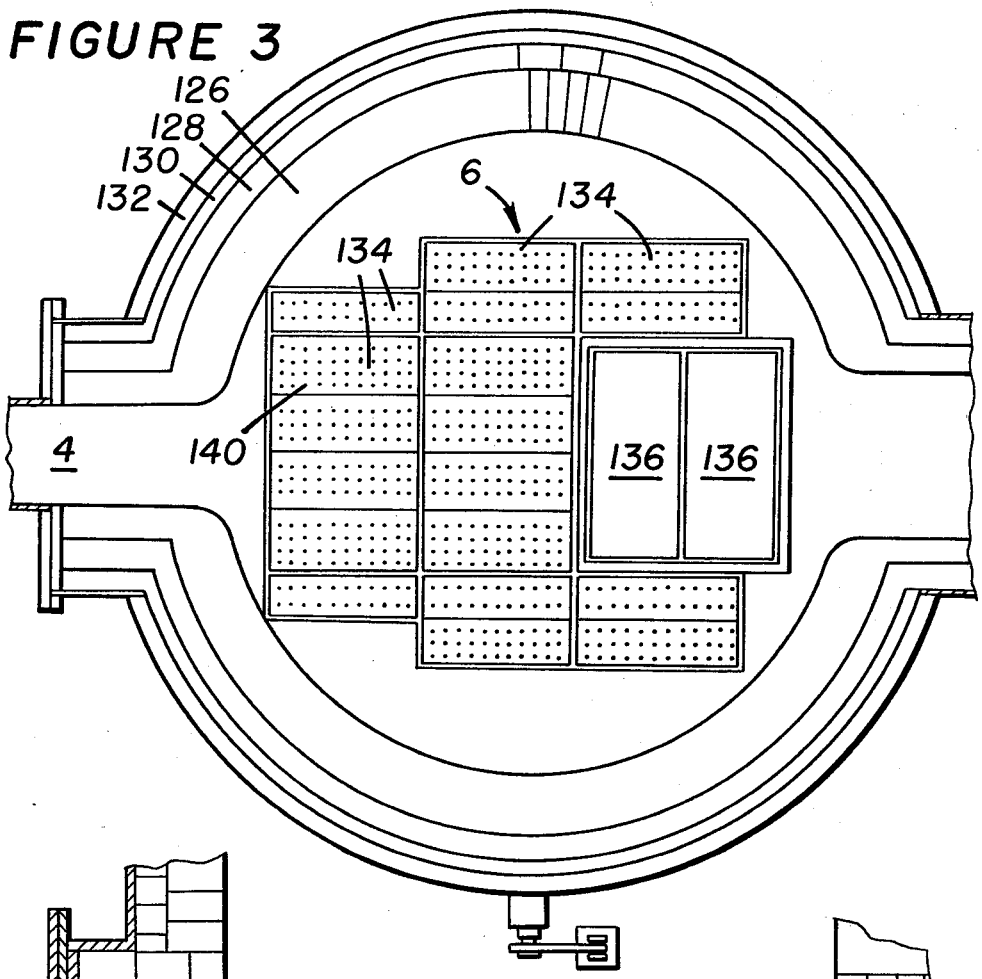
FIG. 3 is a sectional plan view taken along the line 3—3 of FIG. 2.
Figure 2:
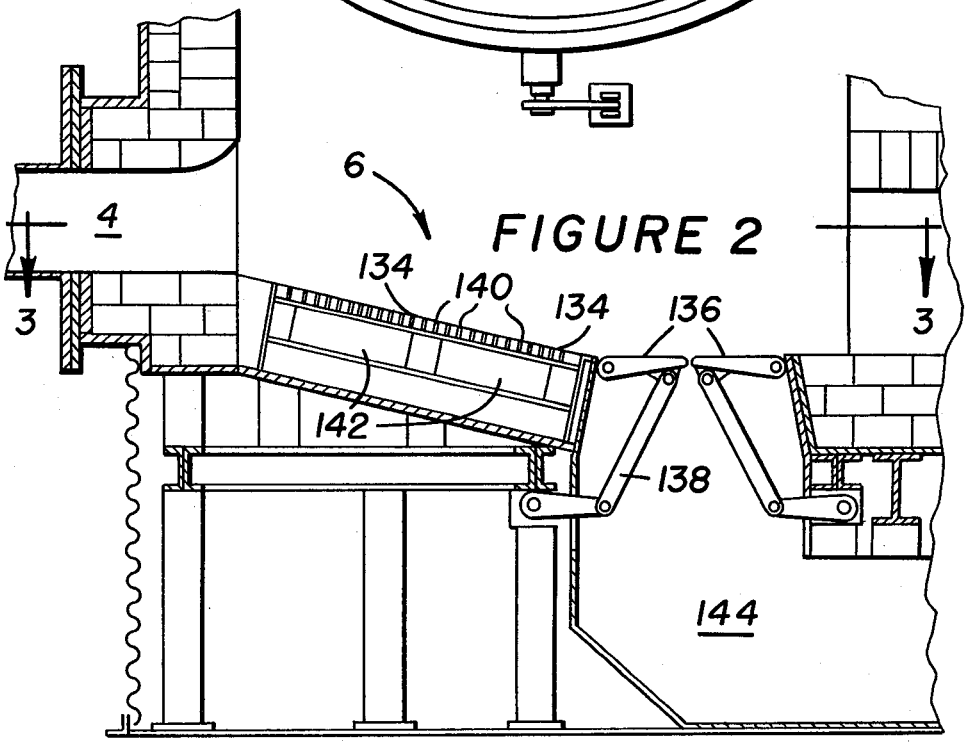
FIG. 2 is a sectional elevation of a portion of the grate and ash removal system of the incinerator stage.

With reference to FIGS. 2 and 3, the construction of the incinerator and the grate and ash removal systems may be appreciated. The incinerator is fabricated from adjacent concentric layers of materials. At 126 is shown a layer of insulated fire brick which is in intimate contact with the combustion process. An outer shell of insulating brick 128 surrounds the fire brick layer. The thermal integrity of the incinerator is assured by an additional layer of block insulation 130 disposed between the insulating brick and a corrugated steel outer shell 132.

The inlet chute 4 is shown transpiercing all of the layers of the incinerator and reaching the interior of the combustion chamber immediately proximate to the grate system, shown generally at 6. The grate system is composed of a plurality of perforated screens 134 disposed both horizontally and on an incline from the fuel inlet 4 to a low point at a pair of dump doors 136 through which ashes are removed, as shown in FIG. 2. The dump doors are suitably actuated by motor driven linkage 138 and are controlled, as are all other operations in the system, through the control panel 124.

In operation, underfire support air from the inlet 12 is fed through pinhole perforations 140 in the grate 134 from a plenum chamber 142. The fuel enters the combustion chamber at 4 and moves progressively down the incline of the grate 134 while air is forced through the perforations 140 to support the combustion process.

Shaking means or other suitable conveying means may be conveniently provided to move the fuel continuously and at a controllable rate from the inlet 4 to the dump doors. Periodically, the dump doors are signalled to open and drop the ashes to the ash collection chamber 144, from which they are conveniently removed by suitable means through the ash removal tunnel 8. The ashes are segregated from the inlet air entering through port 12 by suitable baffles, not shown, which form an inlet air passage extending from the port 12 to the plenum chamber 142.

It may be readily appreciated that the described equipment is capable of totally controlling every parameter in the waste fuel incineration process including the rate and degree of extraction of energy from the waste fuel. Depending upon the heat value and physical description of the particular fuel being consumed, the rate of fuel feed to the combustion chamber may be conveniently varied and the temperature in the combustion chamber or at other points along the system may be controlled by varying the amount of fresh air added to the system through the cooling and overfire fluid ports and by the selective utilization of the overfire burners 16.

The system is capable of measuring and controlling pressure at various points in the system, the flow rate of fluids through the valves and conduits, and the physical position of the various valves in the fluid conduits. With the instant system, the operator can selectively determine the amount of heat extracted from the heat exchanger for outside utilization and can override automatic operations and choose between external utilization of or regeneration of the heated exhaust gases to the combustion chamber to increase the temperature therein.

By controlling the various parameters, the total mass flow of materials through the system may be reduced to an absolute minimum. In a typical example, mass flow was reduced from 41,400 LB/HR (total exhaust products flow at 1,200° F.) using all fresh air (at 60° F.) for cooling, to a low of 8,000 LB/HR (at 1200° F.) using cooled exhaust gases (at 400° F.) for cooling. The advantages of such a drastic reduction in mass flow are apparent. In addition to a lower impact on the environment, the duct work, bag house components, blowers, motors, etc., can all be of smaller dimension and lower in cost.

A typical operational cycle with the control means 124 in its automatic mode (with manual override) would include all functions subsequent to system energization. All dampers or air control valves would move to a startup or low fire position; the burners would ignite; temperatures in the combustion chamber would be permitted to reach 500° F.; and the fuel feed system would commence operation. When the combustion chamber temperature reached 800° F., the burners would shut off. Combustion air flow would respond to the oxygen content signals in the combustion zone. Cold side heat exchanger flow would be set to yield an outlet temperature (to the bag house) of 400° F.

The flow of recirculated cooling gas from the exchanger would respond to the temperature of the exhaust gases at the incinerator outlet. Should combustion chamber temperatures continue to rise, the rate of fuel feed would be reduced and/or oxygen depleted exhaust products from the heat exchanger would be sent to the incinerator as cooling fluid to reduce the combustion rate. Should the inlet temperature to the bag house approach 450° F., the bypass valve 62 would open to shunt the bag house and prevent damage to the bags.

Should the combustion chamber temperature drop to 450° F., the burners would again cycle on. The dump grates would cyclically open to permit removal of ashes.

Like the system shown in U.S. Pat. No. 3,995,567, the instant system includes all of the necessary means for removing pollutants in both gaseous and solid form from the ultimately emitted exhaust products to minimize impact on the environment. The system is designed to increase the efficiency of the burning process so that the lowest possible amount of energy is used for operation of system components while the maximum amount of energy is extracted from the waste fuel.

Although the invention has been described with reference to certain particular preferred embodiments, it will be apparent to those skilled in the art that many variations and modifications of the individual subcombination elements are possible within the spirit of the overall inventive concepts of the combination system. No limitation is intended with respect to such variations and modifications except as comprehended by the scope of the appended claims.

I claim:

1. A low mass flow incineration system for combusting waste fuel and extracting heat energy therefrom, comprising; incinerator means for consuming waste fuel by combustion, a source of waste fuel, said incinerator means including fuel inlet means connecting said source of fuel with said incinerator means, exhaust conduit means connected with said incinerator means for transmitting exhaust products therefrom, a source of primary air for supporting combustion of said waste fuel in said incinerator means, primary air inlet means for transmitting said primary air to said incinerator means, heat exchanger means for transferring heat energy from said exhaust products to a second medium, said exhaust conduit means including regenerative branch means connecting said incinerator means to said heat exchanger means, said incinerator means including coolant inlet means for supplying coolant medium to said incinerator means for reducing the temperature of said exhaust products during the process of combustion, inlet conduit means for supplying said second medium to said heat exchanger means, outlet conduit means for transmitting said second medium from said heat exchanger means, coolant supply conduit means connecting said outlet conduit means with said coolant inlet means for supplying said second medium to said incinerator means subsequent to passage of said second medium through said heat exchanger means, ambient air supply conduit means for supplying ambient air to said coolant inlet means, cooling fluid control means for controlling the flow of cooling fluid to said coolant inlet means and for selectively regulating the proportions of ambient air to said second medium reaching said coolant inlet means, said cooling fluid control means including valve means for selectively mixing said ambient air with said second medium or blocking the flow of either of said ambient air or said second medium to said coolant inlet means.

2. The invention of claim 1, further including bag house means for filtering out and collecting particulate from said exhaust products, said bag house means having inlet and outlet means, said inlet of said bag house means being connected to said exhaust conduit means downstream of said heat exchanger means.

3. The invention of claim 2 further including heat exchanger by-pass duct means for selectively passing exhaust products issuing from said heat exchanger means around said bag house means to said bag house outlet means, said control means including by-pass control valve means for directing heat exchange output to either said bag house inlet or said by-pass duct means.

4. The invention of claim 1 wherein said waste fuel inlet means include fuel inlet chute means for transmitting fuel to said incinerator means, said incinerator means including perforated air grate means for receiving fuel from said chute means, said air grate means including a plurality of perforations, said primary air inlet means including means for supplying primary air to said perforations so that primary air for supporting combustion passes from said perforations and through said waste fuel for combustion thereof.

5. The invention of claim 4 including access and ash removal means proximate said air grate means for permitting the collection and removal of solid residue from the combustion of said waste fuel, said access and ash removal means include selectively actuated dump door means for selectively removing said solid residue from said air grate means.

6. The invention of claim 1 including overfire inlet ports for supplying under pressure combustion supporting medium to said incinerator means at a level therein between said air grate means and said coolant inlet means, said overfire inlet ports being structurally arranged in said incinerator means for causing said combustion supporting medium to move in a swirling pattern within the confines of said incinerator means.

7. The invention of claim 6 including overfire supply conduit means for transmitting said supporting medium to said overfire inlet ports under pressure, said overfire supply conduit means including means for supplying fresh ambient air to said overfire inlet means, said overfire supply conduit means further including means for supplying products of combustion from downstream of said heat exchanger means to said overfire inlet means.

8. The invention of claim 7 wherein said control means include overfire control valve means for selectively mixing and controlling the proportion of fresh air to products of combustion transmitted by said overfire supply conduit means to said overfire inlet ports.

9. The invention of claim 1 including oxygen sensor means in said incinerator means for sensing the oxygen content of said products of combustion in said incinerator means and for signaling said control means to regulate the proportion of ambient air to second medium transmitted to said coolant inlet means.

10. The invention of claim 1 including means for sensing fluid pressure, temperature and flow rate in said incinerator system, means for connecting said sensing means to said control means to provide signals thereto, said control means responding to said signals to control the proportion of ambient fresh air to relatively oxygen depleted products of combustion transmitted to said incinerator means for cooling and for supporting combustion of waste fuel therein.

* * * * *